US009963916B2

(12) United States Patent
Derman

(10) Patent No.: US 9,963,916 B2
(45) **Date of Patent: *May 8, 2018**

(54) SECURITY ANCHOR

(71) Applicant: Jay S. Derman, Temecula, CA (US)

(72) Inventor: Jay S. Derman, Temecula, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/812,942

(22) Filed: Nov. 14, 2017

(65) Prior Publication Data

US 2018/0066456 A1 Mar. 8, 2018

Related U.S. Application Data

(60) Continuation of application No. 15/470,888, filed on Mar. 27, 2017, now Pat. No. 9,816,298, which is a division of application No. 15/040,628, filed on Feb. 10, 2016, now Pat. No. 9,603,446.

(60) Provisional application No. 62/249,418, filed on Nov. 2, 2015.

(51) Int. Cl.
*E05B 73/00* (2006.01)
*A47B 21/04* (2006.01)

(52) U.S. Cl.
CPC ..... *E05B 73/0082* (2013.01); *A47B 21/04* (2013.01); *E05B 73/00* (2013.01); *E05B 73/0005* (2013.01)

(58) Field of Classification Search
USPC ..... 248/551, 552; 70/18, 58
See application file for complete search history.

(56) References Cited

U.S. PATENT DOCUMENTS

| | | | | |
|---|---|---|---|---|
| 5,002,251 | A * | 3/1991 | Kranenberg | B60R 13/005 248/503 |
| 7,393,033 | B1 * | 7/2008 | Bisso, IV | F16G 15/06 294/82.1 |
| 9,603,446 | B1 * | 3/2017 | Derman | A47B 21/06 |
| 9,816,298 | B2 * | 11/2017 | Derman | E05B 73/0082 |
| 2013/0015316 | A1 * | 1/2013 | Czajor | B65H 75/366 248/552 |

* cited by examiner

*Primary Examiner* — Alfred Wujciak
(74) *Attorney, Agent, or Firm* — Aaron McGushion

(57) ABSTRACT

The present anchor device provides a support for holding a security anchor within a hole, such as a grommet hole, formed through a work surface, such as a table top, a shelf, or other board or sheet. The security anchor has a loop for attaching a lock or receiving a cable lock wrapped about the loop and a cross member to prevent the withdrawal of the security anchor from the grommet hole. The anchor device has a cross member optionally with a dipped portion that supports the loop of the security anchor. The present support device prevents the security anchor from falling down through the hole, while holding the loop of the security anchor just within the hole and within easy grasp of the user.

10 Claims, 5 Drawing Sheets

SECURITY ANCHOR

RELATED APPLICATION DATA

This application is a continuation of U.S. application Ser. No. 15/470,888 which issued as U.S. Pat. No. 9,816,298 Nov. 14, 2017, which is a divisional of U.S. application Ser. No. 15/040,628 which issued as U.S. Pat. No. 9,603,446 on Mar. 28, 2017, which, in turn, claims the priority date of provisional application No. 62/249,418 filed on Nov. 2, 2015, each of which is herein incorporated by reference in its entirety.

BACKGROUND

The field of the present device and method relates to lock accessories for fastening objects to a work surface, and more particularly, to lock accessories which insert through a grommet hole through the work surface.

It is often a desire to secure expensive or important items to a particular location, to prevent theft or loss. In a workplace, computers, portable devices, and computer peripherals are commonly locked into place using brackets or cable locks. The cable locks include a lock member attached to the end of a steel cable having a closed loop on the opposite end. The lock member at the end of the cable lock may lock to a security slot formed in the device, such as in a laptop computer, projector, monitor, cash register, money box, gun, rifle, firearm, handcuff, and the like.

One type of lock product compatible with the security slot is made by KENSINGTON and is known as the MICRO-SAVER lock, which is disclosed in U.S. Pat. Nos. 6,081,974, 6,317,936; 6,360,405, 7,204,106, 7,409,842 and U.S. App. Nos. 2011/0179834 and 2011/0122551. Yet another compatible lock is sold by KENSINGTON and is known as the CLICKSAFE lock, which is also disclosed in U.S. Pat. Nos. 7,730,751, 7,963,132, 7,997,106, 8,001,812, 8,042,366, 8,230,707, U.S. App. Nos. 2012/0125057 and 2011/0072863, and U.S. Des. Pat. Nos. D651,889, D660,682, and D661,975.

Other types of lock product compatible with the security slot are patented by the present inventor, Jay Derman, are disclosed in U.S. Pat. Nos. 8,640,511, 8,646,294, 8,726,703, 8,783,073, 8,899,080, and 8,935,943.

The cable lock may then be wrapped about part of a desk, such as the leg, and looped through itself and locked to the object to essentially tie the object to the desk or other difficult to move anchor point. In the case of a laptop or other device that must often be removed from the immediate area, the cable lock may slide off the table and under or behind the desk, requiring the cable lock be retrieved from an inconvenient location. What is needed is a means to hold the cable lock atop the desktop and to provide a convenient anchor for the lock.

SUMMARY

The present support device provides a support for holding a security anchor or lock anchor within a hole, such as a grommet hole, formed through a work surface, such as a table top, a shelf, or other board or sheet. The present support device prevents the security anchor from falling down through the hole, while holding the loop of the security anchor just within the hole and within easy grasp of the user.

A security anchor is provided for use with a hole formed through a work surface with an underside and a top surface, where the security anchor is attachable to a lock for securing an object to the work surface. The security anchor generally comprises a loop supporting cross member and a security anchor. The loop supporting cross member generally comprises a first end opposite a second end, where the loop supporting cross member is configured to span the hole of the work surface with the first end and the second end supported about the hole in a supporting configuration. The security anchor generally comprises a loop attached to an anchoring cross member, the loop sized to be inserted through the hole from the underside, where the anchoring cross member has a dimension larger than the hole and is sized to prevent the anchoring cross member from being pulled through the hole from the top surface.

When the loop supporting cross member is in the supporting configuration, the loop supporting cross member is inserted through the loop to support the security anchor by the loop, with at least a part of the loop positioned above the top surface and the anchoring cross member positioned below the underside. And, the loop supporting cross member provides sufficient access to the through hole to permit the routing of a plurality of device cables through the hole. And, the loop is configured to be lifted above the top surface for insertion therethrough the lock to attach the object to the security anchor.

Optionally, the security anchor may comprise a grommet with a curved sidewall defining a through hole, where the curved sidewall is sized to fit within the hole to line at least a portion of the hole, with the grommet including a flange extending from the curved sidewall and having a top and configured to rest on the work surface to support the grommet within the hole. And, as an option, the loop supporting cross member is supported by the grommet.

Again, optionally, the anchoring cross member may be elongated. The anchoring cross member may be an elongated plate. Optionally, the loop of the security anchor is a shackle secured to the anchoring cross member. The shackle may be U-shaped. The loop supporting cross member may be a rod with a dipped portion formed by bending the rod between the first end and the second end. The dipped portion may be a U-bend and a square U-bend. Also, the loop supporting cross member may be inserted through loop by lifting one or both of the first end and the second end.

Figure 3:
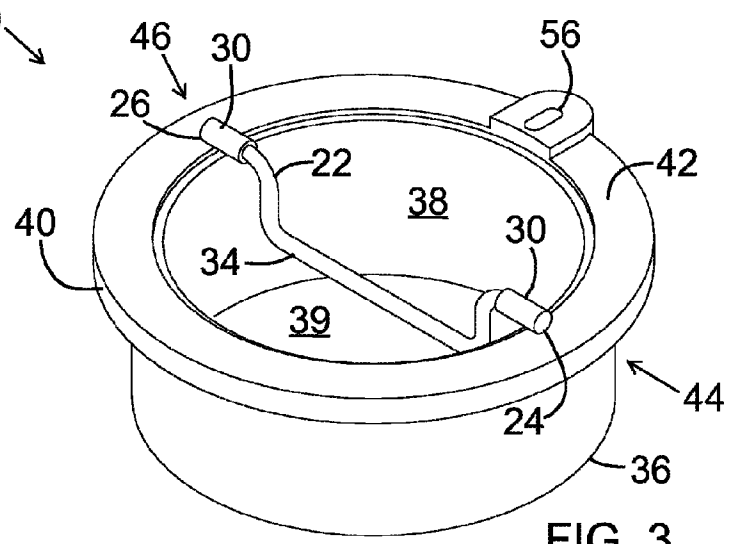
FIG. 3 is a perspective view of the loop supporting cross member supported by a grommet.

LISTING OF REFERENCE NUMERALS OF FIRST-PREFERRED EMBODIMENT support device 20
loop supporting cross member 22
first end 24
second end 26
dipped portion 28
grip sleeve 30
U-bend 32
square U-bend 34
grommet 36
curved side wall 38
axial hole 39
flange 40
top 42
first portion 44
second portion 46
first groove 48
second groove 50
first hole 52
second hole 54
security slot 56
depth d
security anchor 100
loop 102
anchoring cross member
cross-sectional dimension D
work surface 200
grommet hole 202
top surface 204
underside 206
computer 300
peripheral device 302
power/data cable 304
cash register 306
cable lock 400
cable loop 402
lock 404
cable lock 406
cable loop 408

DESCRIPTION OF THE PREFERRED EMBODIMENTS

The detailed descriptions set forth below in connection with the appended drawings are intended as a description of embodiments, and is not intended to represent the only forms in which the present securement system may be constructed and/or utilized. The descriptions set forth the structure and the sequence of steps for constructing and operating the securement system in connection with the illustrated embodiments. It is to be understood, however, that the same or equivalent structures and steps may be accomplished by different embodiments that are also intended to be encompassed within the spirit and scope of the invention.

Figure 2:
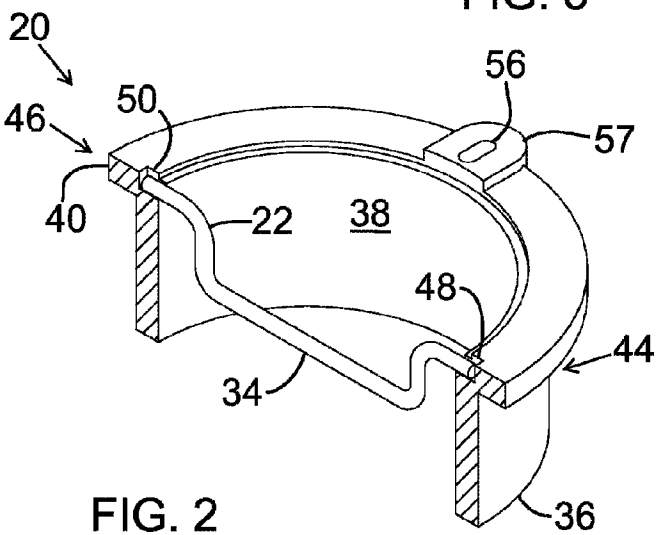
FIG. 2 is a cross-sectional perspective view of the embodiment of FIG. 1, showing a loop supporting cross member installed on the grommet.
Figure 1:
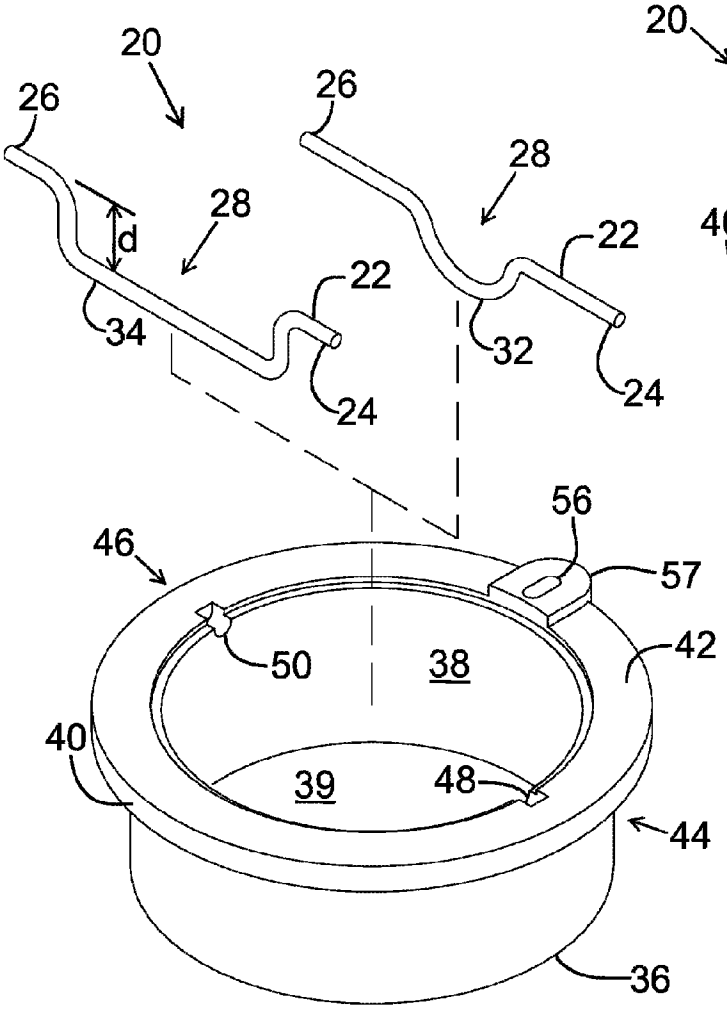
FIG. 1 is an exploded perspective view of the present support device, showing two versions of the loop supporting cross member in position to be placed on the grommet.

FIGS. 1 and 2 illustrate example embodiments of the present anchor device (20), showing two variations of the loop supporting cross member (22). The loop supporting cross members (22) are similarly constructed, except the dipped portion (28) in one loop supporting cross member (22) is a U-bend (32) and the dipped portion (28) in the other loop supporting cross member (22) is a square U-bend (32). The loop supporting cross member (22) can be made of a variety of materials, such as a bent metal rod, as illustrated herein. The dipped portion (28) can be created by a standard wire bending machine, by use of a bending jig, or may be stamped, or other known manufacturing technique. The loop supporting cross member (22) has a first end (24) opposite a second end (26), with the dipped portion (28) formed between. In one example embodiment, the depth (d) of the dipped portion (28) is preferably equal to or greater than the cross-sectional diameter (D) of the loop (102) of the security anchor (100). In other words, it is preferred that the loop (102) be recessed within the grommet (36) to maintain a clean work surface (200 appearance and reduce the possibility of snagging or catching the loop (102). The depth (d) of the dipped portion (28), however, may be less than the cross-sectional diameter (D) of the loop (102), if it is a desire to keep the loop slightly above the top (42) of the grommet (36) flange (40). As will be discussed in greater detail below, the square U-bend (34) may be constructed wider than the U-bend (32) to provide more lateral space for the loop (102) to rest within and to limit the lateral travel of the loop supporting cross member (22) in certain embodiments.

An exemplary grommet (36) is designed to fit within a standard sized grommet hole (202) drilled through a work surface (200), such as a desktop, for routing cables through the desktop. The curved sidewall (38) defines an axial hole (39) formed through the grommet (36). A circular flange (40) with a top (42) extends from the top of the curved sidewall (38). The flange (40) may optionally have a security slot (56) in a reinforced portion (57) of the flange (40) for receiving the CLICKSAFE or MICROSAVER type lock. The user may choose to temporarily lock the CLICKSAFE or MICROSAVER to the security slot (56) to prevent loss of the lock and attached cable when the cable lock (400) is not attached to an object, such as when a laptop is removed from the desk. The security slot (56) could be reinforced to provide a high level of resistance to pulling or breaking to discourage the casual removal of the cable lock (400).

The grommet (36) has a first groove (48) formed on a first portion (44) of the grommet (36), and a second groove (50) formed on a second portion (46) of the grommet (36). In the illustrated example, the grooves (48, 50) are formed partially through the curved sidewall (38) and terminate into the flange (40) at the top (42). The first groove (48) is sized to receive the first end (24) of the loop supporting cross member (22); and the second groove (50) is sized to receive the second end (26) of the loop supporting cross member (22). The grooves (48, 50) may be sized such that the ends (24, 26) must be pressed or snapped into place, being frictionally mechanically held within their respective grooves (48, 50), so that the user can overcome the connection between the ends (24, 26) and the grooves (48, 50) to remove the loop supporting cross member (22) from the grommet (36).

When the loop supporting cross member (22) is detached, wholly or just by one end, the loop (102) of the security anchor (100) can be inserted through the axial hole (39) of the grommet (36) and the loop supporting cross member (22) be inserted through the loop (102). Thereafter, the loop supporting cross member (22) can be snapped back into the grooves (48, 50), trapping the security anchor (100) by the loop (102), preventing it from dropping through the axial hole (39).

FIG. 3 illustrates a variation of the grommet (36) of FIGS. 1-2, where the grooves (48, 50) are eliminated. Instead, the loop supporting cross member (22) has a sleeve (30) over the first end (24) and the second end (26). The sleeve (30) could be made of plastic or rubber, where each end (24, 26) can be dipped into a liquid coating. Optionally, the sleeve (30) can be made of heat-shrink tubing, heated and shrank onto the ends (24, 26). The sleeves (30) provide a gripping action between the loop supporting cross member (22) and the top (42) of the flange (40), and a means to prevent marring as cables and wires move within the grommet (36).

In the example embodiment of FIG. 3, the loop supporting cross member (22) is simply lifted to insert it through the loop (102) of the security anchor (100), and placed back on the top (42) of the flange (40). The square U-bend (34) has a width that is configured to be almost as wide as the axial hole (39) diameter to minimize the lateral travel of the loop supporting cross member (22) within the axial hole (39).

Figure 5:
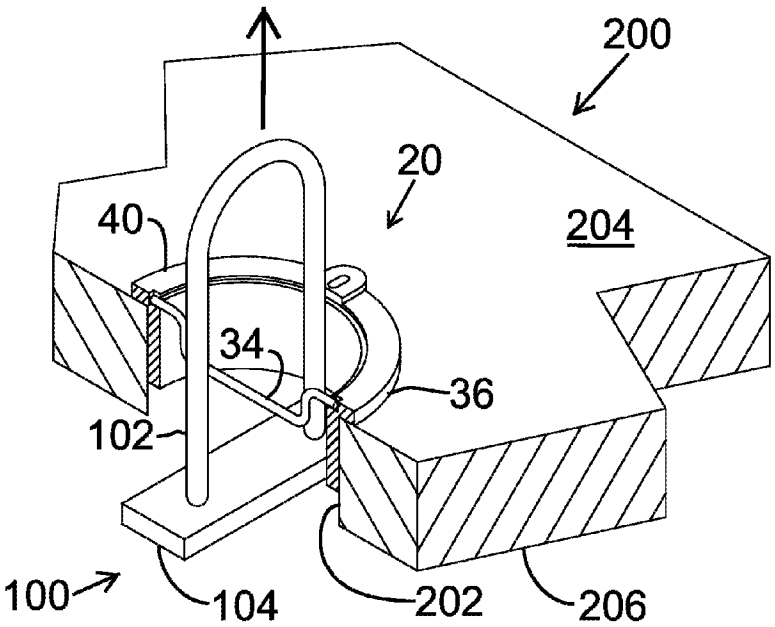
FIG. 5 is a cross-sectional perspective view of the embodiment of FIG. 1, showing a loop supporting cross member installed on the grommet with the loop of the security anchor lifted out of the grommet hole.
Figure 4:
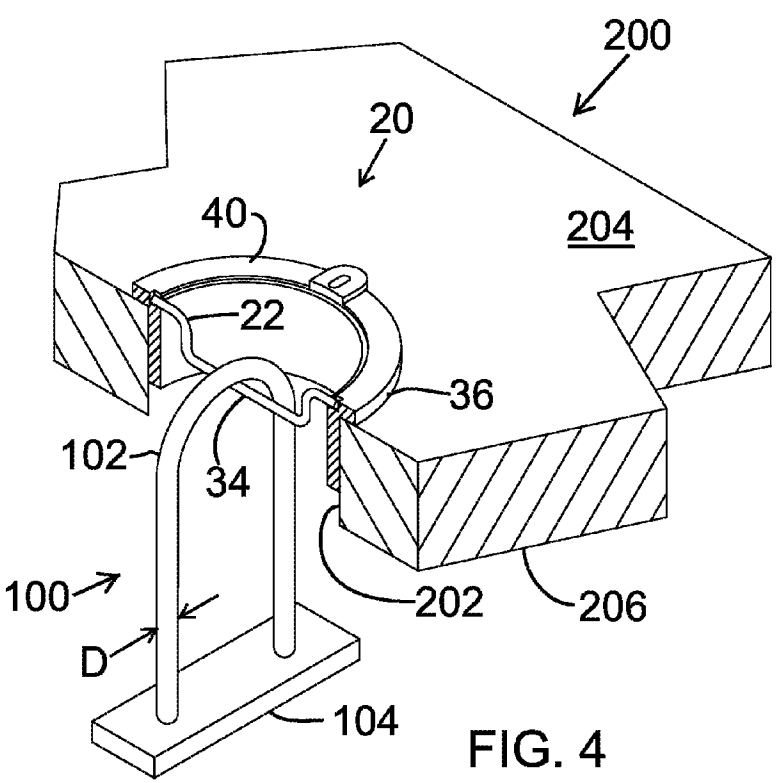
FIG. 4 is a cross-sectional perspective view of the embodiment of FIG. 1, showing a loop supporting cross member installed on the grommet and supporting an security anchor by the loop in a desktop.

FIGS. 4 and 5 illustrate the usage of the embodiment of the anchor device (20) of FIGS. 1 and 2. FIG. 4 illustrates how the present loop supporting cross member (22) holds the loop (102) of the security anchor (100) within the axial hole (39) of the grommet (36). In this example, the loop (102) is a U-shaped shackle bolted or welded to a plate serving as the anchoring cross member (104). The loop (102) rests on the loop supporting cross member (22) at the square U-bend (34), holding the loop (102) just beneath the top surface (204) of the work surface (200) and beneath the top (42) of the flange (40). The anchoring cross member (104), in this case an elongated plate, is sized greater than the grommet hole (202) along at least one dimension such that it cannot fit through the grommet hole (202). In this example, the anchoring cross member (104) is too long to fit through the grommet hole (202). Further, the loop (102) prevents the angling or side-to-side manipulation of the security anchor (100) to pull it though the grommet hole (202).

FIG. 5 shows the security anchor (100) being lifted upwardly in the direction of the arrow, usually by grasping the loop (102), and being blocking from being pulled through the grommet hole (202) by the anchoring cross member (104). In this position, a lock can be wrapped through and about the loop (102) to lock it thereto. Additionally, the shackle of a padlock or the cuff of a pair of handcuffs can be locked through the loop (102). The present anchor device (20) and security anchor (100) leave sufficient space within the axial hole (39) for the threading and arrangement of multiple cables for powering devices and transmitting data.

Figures 6, 7:
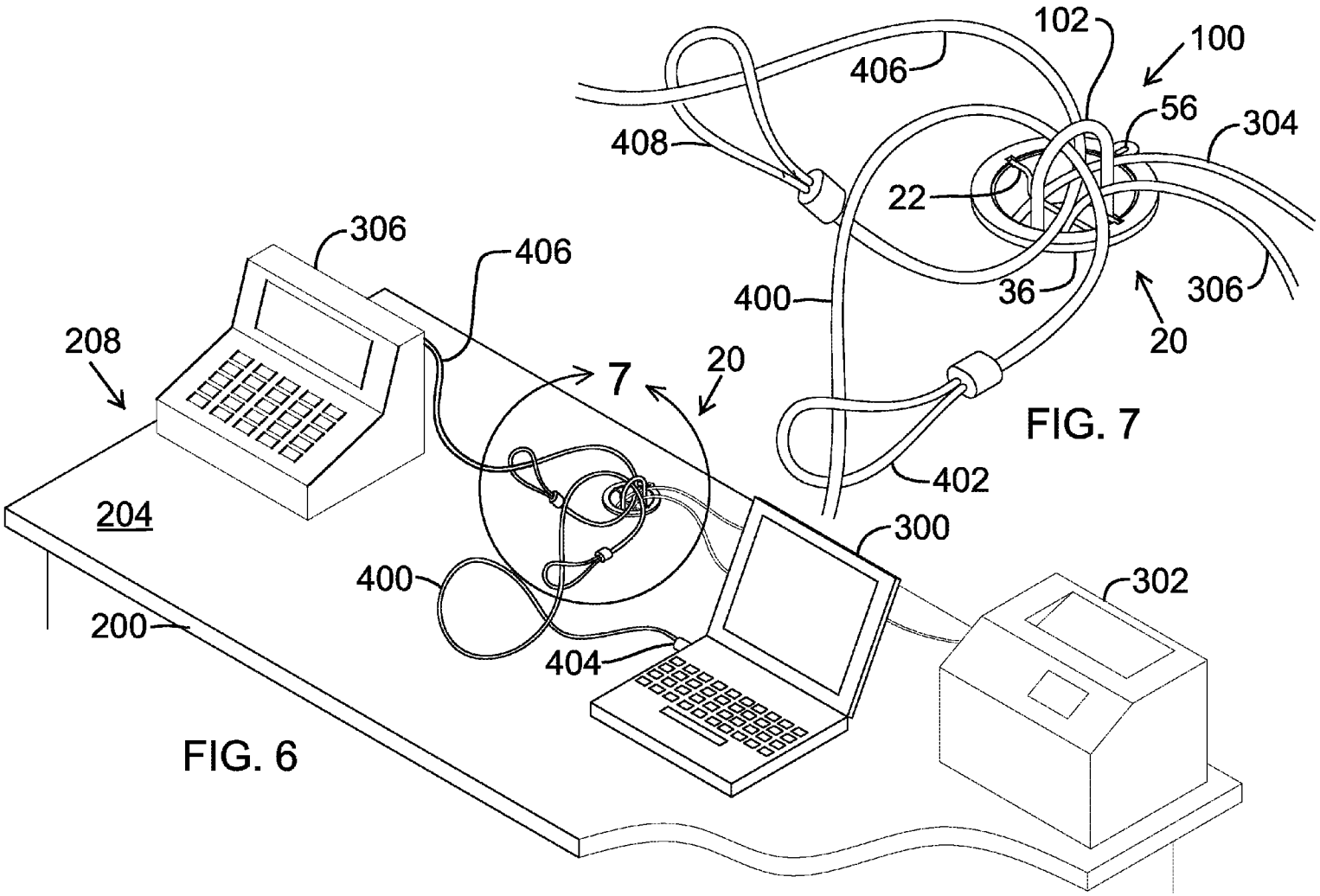
FIG. 6 illustrates an example usage of the present support device, installed within a typical desk with a cable lock threaded through the loop of the security anchor.
FIG. 7 is a partial magnified view of FIG. 6, showing the present support device in greater detail.

FIGS. 6 and 7 illustrate an exemplary desk (208) with a laptop (300) and a printer (302) resting atop the work surface (200). A power cable (304) runs from the printer (302) and through the grommet (36). Similarly, power cable (306) runs from the laptop (300) and also through the grommet (36). A cable lock (400) connects to the laptop (300) by a lock (404), such as the aforementioned MICROSAVER lock system. Before locking the lock (404) to the laptop (300), the lock (404) end of the cable is inserted through the loop (102) of the security anchor (100), then though the cable loop (402), and afterwards, locked to the laptop (300) to secure the laptop (300) to the desk (208).

FIG. 7 more closely shows the cable lock (400) and the second cable lock (406) both threaded through the loop (102) of the security anchor (100). Cable lock (400) is attached to a laptop (300); and cable lock (406) is attached to a cash register (306). Once locked to the laptop (300) or the cash register (306), any upward pulling on the cable lock (400) or cable lock (406), will lift the security anchor (100) upwards and partially out of the grommet (36), with the travel being limited by the anchoring cross member (104) catching on either or both sides of the grommet hole (202) at the underside (206). In this way, the laptop (300) and cash register (306) cannot be removed from the vicinity of the desk (208), without breaking the plastic case of the laptop (300) or the lock portion of the cash register (306). Similarly, the printer (302) (or other device, peripheral device, object, or even a person in the case of a handcuff) can be attached and locked to the security anchor (100). When the laptop (300) is taken to another location, the cable lock (400) can be removed entirely, so that the loop (102) of the security anchor (100) drops into the grommet (36) axial hole (39) and is supported just within the axial hole (39) by the loop supporting cross member (22). FIG. 7 also shows that the present security anchor (100) and loop supporting cross member (22) leave ample room within the axial hole (39) for the various cables routed through the grommet (36).

Figure 8:
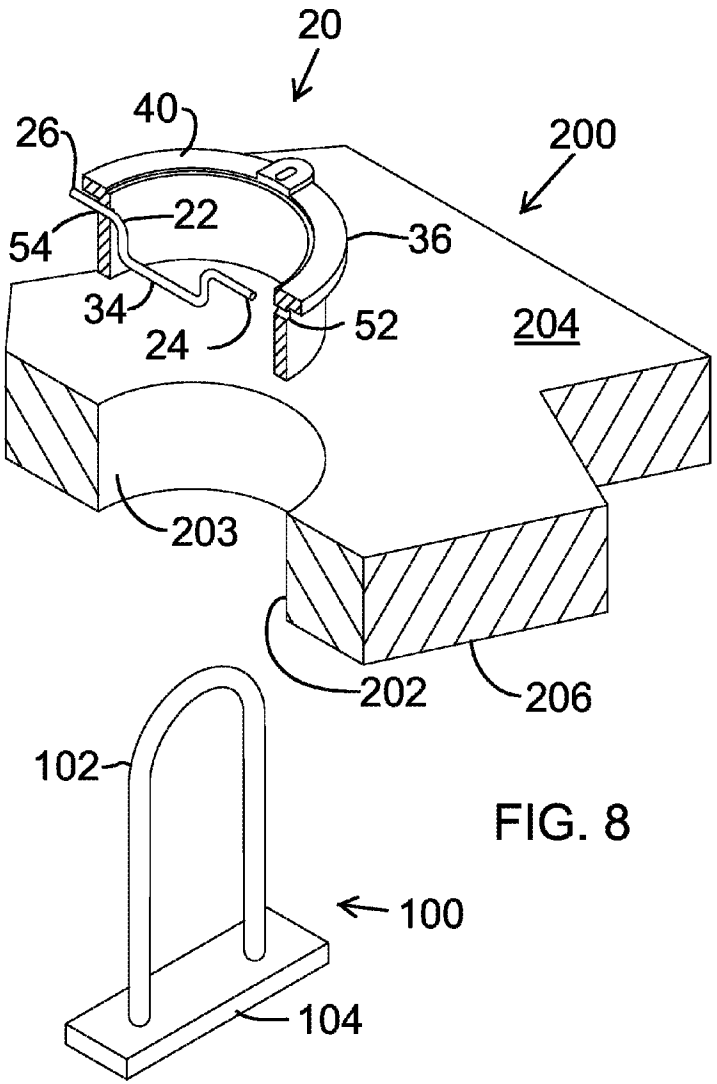
FIG. 8 is an exploded partial cross-sectional perspective view of an alternate embodiment, showing the loop supporting cross member in the open position and ready to receive the loop of the security anchor.
Figure 9:
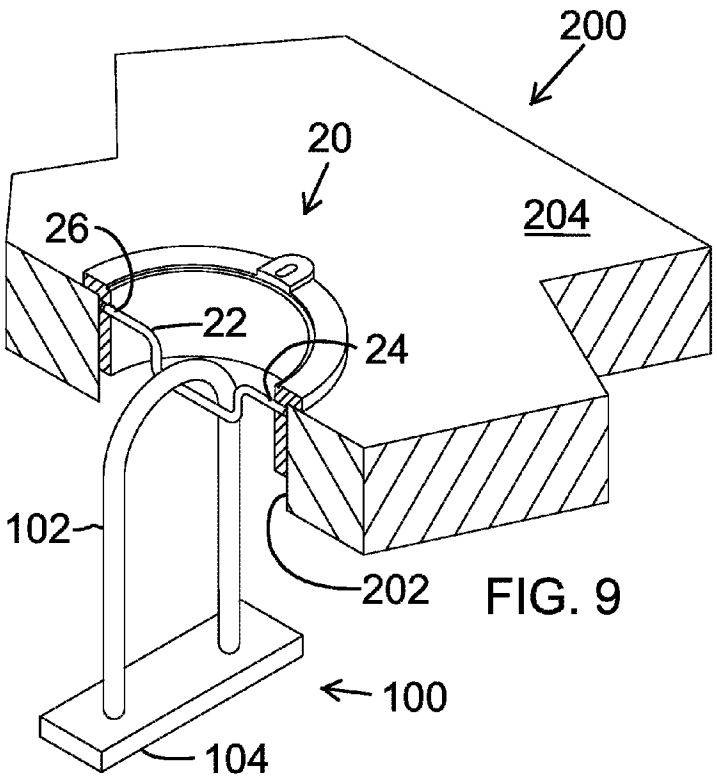
FIG. 9 is a cross-sectional perspective view of the alternate embodiment of FIG. 8, showing a loop supporting cross member installed on the grommet and supporting an security anchor by the loop in a desktop.

FIGS. 8 and 9 illustrate an alternate embodiment of the present grommet (36) and loop supporting cross member (22). In particular, the grommet (36) has a first hole (52) formed through the curved side wall (38) at the first portion (44) of the grommet (36), and a second hole (54) formed through the curved side wall (38) at the second portion (46) of the grommet (36). The first hole (52) receives and supports the first end (24) of the loop supporting cross member (22). The second hole (54) receives and supports the second end (26) of the loop supporting cross member (22).

When the grommet (36) is lifted from the grommet hole (202), the first hole (52) and the second hole (54) are no longer blocked by the wall (203) of the grommet hole (202), so that the loop supporting cross member (22) can be moved axially with the either hole to free the opposite end. In the illustrated example, the second end (26) is pushed through the second hole (54), pulling the first end (24) out of the first hole (52) freeing the second end (24) from the first hole (52). In this configuration, the loop (102) of the security anchor (100) may be pushed up through the grommet hole (202) and the loop supporting cross member (22) inserted through the loop (102) by the first end (24). The first end (24) of the loop supporting cross member (22) is pushed back into the first hole (52) and the assembly comprising the loop supporting cross member (22), the grommet (36), and the security anchor (100) are fitted back into the grommet hole (202). When fitted in the grommet hole (202), the loop supporting cross member (22) is blocked from withdrawing from the holes (52, 54) by the grommet hole (202) wall (203), as shown in FIG. 9.

Figure 10:
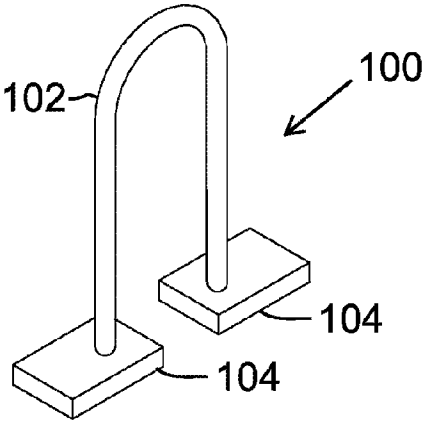
FIG. 10 is a perspective view of one embodiment of the loop supporting cross member.

FIGS. 10-14 show several of the many possible designed of the present security anchor (100). In FIG. 10, instead of the single elongated anchoring cross member (104) there are two anchoring cross members (104), one extending from each leg of the loop (102). The loop (102) is not a closed loop, yet can become effectively mechanically closed when locked in position through a grommet (36) by a lock or cable lock (400) incapable of being pulled through the axial hole (39) of the grommet (36). The design of FIG. 10 may also be created by outwardly bending the free end of each leg of the loop (102), creating an omega-shaped profile.

Figure 14:
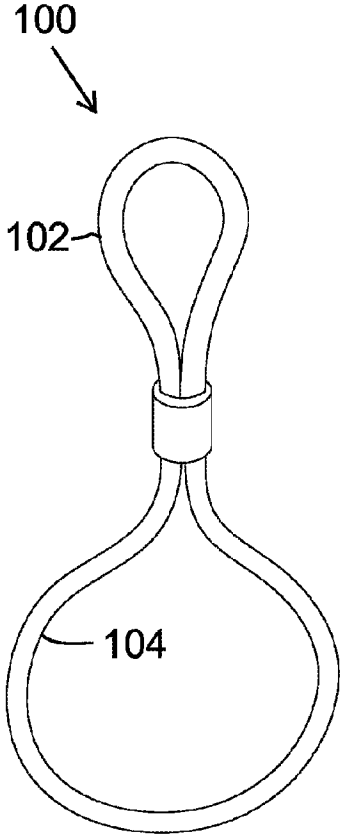
FIG. 14 is a perspective view of one embodiment of the loop supporting cross member
Figure 11:
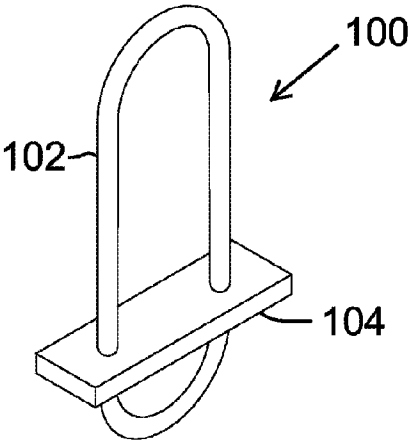
FIG. 11 is a perspective view of one embodiment of the loop supporting cross member.
Figure 13:
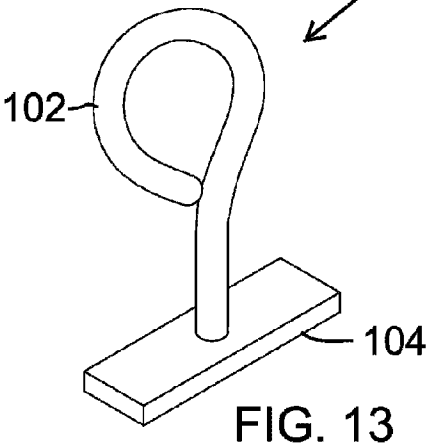
FIG. 13 is a perspective view of one embodiment of the loop supporting cross member.
Figure 12:
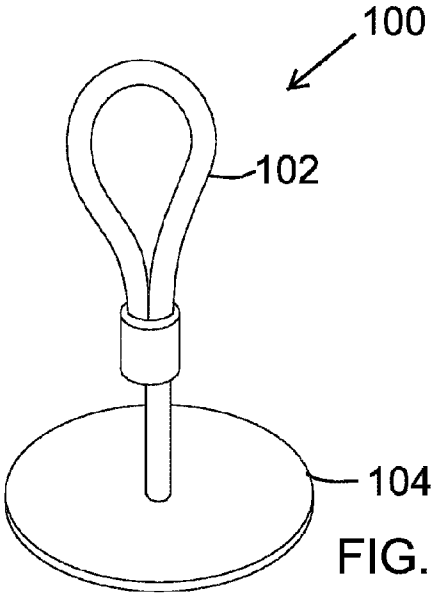
FIG. 12 is a perspective view of one embodiment of the loop supporting cross member.

FIG. 11 illustrates an oval-shaped or link-shaped loop (102) that is created by bending a rod and butt welding the ends together after inserting the loop (102) through the anchoring cross member (104). The embodiment of FIG. 12 is created by crimping a loop (102) at one end of a cable and fastening the opposite end of the cable to disk-shaped anchoring cross member (104). FIG. 13 shows an eye bolt fastened to an elongated anchoring cross member (104), where the eye forms a loop (102). And FIG. 14 illustrates a cable crimped to form a figure eight, with the smaller top portion forming the loop (102), where the top portion is able to be fitted through the axial hole (39) of the grommet (36), and the larger bottom portion forms the anchoring cross member (104), because the bottom portion is too large and inflexible to be fitted through the axial hole (39) of the grommet (36).

While particular forms of the present securement system have been illustrated and described, it will also be apparent to those skilled in the art that various modifications can be made without departing from the spirit and scope of the design. Accordingly, it is not intended that the invention be limited except by the claims.

What is claimed is:

1. A security anchor for use with a hole through a work surface with an underside and a top surface, the security anchor attachable to one or both of a lock or a lock cable for securing an object to the work surface, the security anchor comprising:

a loop supporting cross member comprising a first end opposite a second end, the loop supporting cross member configured to span the hole with the first end and the second end supported across the hole in a supporting configuration, wherein the first end and the second end are configured to rest on the work surface; and a security anchor comprising a loop attached to an anchoring cross member, the loop sized to be inserted through the hole from the underside, the anchoring cross member having a dimension larger than the hole and being sized to prevent the anchoring cross member from being pulled through the hole from the top surface;

wherein, when the loop supporting cross member is in the supporting configuration, the loop supporting cross member is inserted through the loop to support the security anchor by the loop, with the anchoring cross member positioned below the underside;

and wherein the loop supporting cross member is configured to provide sufficient access to the through hole to permit the routing of a plurality of device cables through the hole;

and wherein the loop is configured to be lifted above the top surface for insertion therethrough the lock or the lock cable to attach the object to the security anchor.

2. The security anchor of claim 1 further comprising a grommet with a curved sidewall defining a through hole, the curved sidewall sized to fit within the hole to line at least a portion of the hole, the grommet having a flange extending from the curved sidewall and having a top and configured to rest on the work surface to support the grommet within the hole.

3. The security anchor of claim 2 wherein the loop supporting cross member is supported by the grommet.

4. The security anchor of claim 1 wherein the anchoring cross member is elongated.

5. The security anchor of claim 4 wherein the anchoring cross member is an elongated plate.

6. The security anchor of claim 1 wherein the loop of the security anchor is a shackle secured to the anchoring cross member.

7. The security anchor of claim 1 wherein the shackle is U-shaped.

8. The security anchor of claim 1 wherein the loop supporting cross member is a rod with a dipped portion formed by bending the rod between the first end and the second end.

9. The security anchor of claim 8 wherein the dipped portion is one of a U-bend and a square U-bend.

10. The security anchor of claim 1 wherein the loop supporting cross member is inserted through loop by lifting one or both of the first end and the second end.

* * * * *